US005601127A

United States Patent [19]

Hanson

[11] Patent Number: 5,601,127

[45] Date of Patent: Feb. 11, 1997

[54] BEVERAGE DISPENSER CLEANING SYSTEM

[76] Inventor: Scott A. Hanson, 2032 County Road A, Neenah, Wis. 54956

[21] Appl. No.: 515,713

[22] Filed: Aug. 16, 1995

[51] Int. Cl.[6] ..... B65B 1/04; B65B 3/04

[52] U.S. Cl. ..... 141/91; 137/240; 222/148; 134/169 R

[58] Field of Search ..... 141/89, 90, 91, 141/99, 100, 102, 104; 137/240; 222/148; 134/169 R, 169 C

[56] References Cited

U.S. PATENT DOCUMENTS

| | | | |
|---|---|---|---|
| 2,770,248 | 11/1956 | Audia | 137/240 |
| 3,945,536 | 3/1976 | Doak | 222/148 |
| 4,527,585 | 7/1985 | Mirabile | 137/240 |
| 4,572,230 | 2/1986 | Mirabile | 137/240 |
| 4,582,226 | 4/1986 | Doak | 222/148 |
| 4,606,476 | 8/1986 | Pocock et al. | 222/148 |
| 4,615,466 | 10/1986 | Credle, Jr. | 222/148 |
| 4,941,593 | 7/1990 | Hicks et al. | 222/148 |
| 5,090,440 | 2/1992 | Ladouceur et al. | 137/240 |
| 5,343,907 | 9/1994 | Wagner | 141/89 |

*Primary Examiner*—Henry J. Recla
*Assistant Examiner*—Steven O. Douglas
*Attorney, Agent, or Firm*—Ryan, Maki, Mann & Hohenfeldt

[57] ABSTRACT

A system for sanitizing beverage dispensing equipment includes a plurality of beverage sources such as kegs, each connected to a dispensing tap by means of a connecting conduit removably coupled to one of the sources and the tap. A manifold includes a plurality of flexible hoses attached thereto. Each of the hoses has a first end in fluid flow connection with the manifold body and a second end provided with a fitting adapted to be connected to one of the connecting conduits when it is disconnected from its beverage source. A source of solution for cleaning or sanitizing the taps and the connecting conduits is provided. A pump is connected by an inflow hose to the solution source and is connected to an outflow hose which has an output end with a fitting adapted to be connected in fluid flow communication to one of the connecting conduits when it disconnected from its beverage dispensing tap. Thus the cleaning solution can be circulated from the source through the one tap to the manifold and outward through the connecting conduits to the other taps. The taps are cleaned individually by successively opening each tap to permit outflow of sanitizing solution, which is preferably recovered in the source container and thus recycled through the system.

4 Claims, 2 Drawing Sheets

BEVERAGE DISPENSER CLEANING SYSTEM

FIELD OF THE INVENTION

This invention relates to a system for cleaning beverage dispensing equipment. More specifically the invention relates to a system for rapidly and conveniently cleaning systems such as multiple beer keg/tap arrangements typical in beverage serving establishments.

BACKGROUND OF THE INVENTION

Various arrangements have heretofore been devised for cleaning and/or sanitizing beverage dispensing systems such as those used for dispensing draft beer or similar beverages. In many instances a cleaning system is built in as a component of the beverage dispensing system itself. See for example, U.S. Pat. Nos. 4,941,593; 5,090,440 or 5,343,907.

Typically, however, a beer wholesaler will provide as a service to customers the cleaning and sanitizing of the customer's beer dispensing equipment on a periodic basis. Many establishments, however, have a cooler within which beer kegs are located in the basement of the establishment and dispensing taps located at a bar area a different level within the building. Typically, cleaning is still performed in such establishments by successively running cleaning/sanitizing solutions through each of a series of hoses and taps. Usually there will be one tap for each of a number of different brands of draft beverage served at the particular establishment which are connected by a similar number of hoses to kegs located in a cooler. The typical cleaning procedures and equipment thus require the person doing the cleaning to ascend and descend the stairs a number of times. Thus the cleaning procedures in still common use are wasteful of both time and energy.

SUMMARY OF THE INVENTION

It is a primary object of the present invention to provide a beverage dispensing equipment cleaning device that is both economical to manufacture and which eliminates wasted time and effort and thus makes the cleaning procedure more cost efficient.

In accordance with one aspect of the invention a manifold type device is utilized to simultaneously attach each of a number of hoses leading to taps to a source of cleaning/sanitizing solution. In accordance with a related aspect, the manifold device is made from a section of flexible hose or conduit material to which is connected a series of hose sections with valves therein and with fittings on their free ends adapted to be attached to the beverage dispensing system when it is disconnected from each of the beverage-containing kegs.

In accordance with a further aspect of the invention the cleaning system is provided with a single circulating pump which can be utilized to maintain a flow of cleaning/sanitizing solution from a source thereof into each individual hose of the system and through a number of dispensing taps in an establishment. In accordance with a still further aspect of the invention the system is adapted to return the circulated cleaning/sanitizing solution from individual taps to the source container.

In accordance with a further related aspect of the invention a single pump is utilized to connect the cleaning system to one of the beverage dispensing taps through which the cleaning sanitizing solution is pumped in a direction reverse to that of the normal beverage flow to the manifold from which the cleaning/sanitizing solution is then circulated from the manifold to the other taps.

Briefly, the invention provides a system for sanitizing beverage dispensing equipment which includes a plurality of beverage sources such as kegs, each connected to a dispensing tap by means of a connecting conduit removably coupled to one of the sources and the tap. A manifold, as a component of the cleaning system, includes a plurality of flexible hoses attached thereto. Each of the hoses has a first end in fluid flow connection with the manifold body and a second end provided with a fitting adapted to be connected to one of the connecting conduits after it has been disconnected from its beverage source. A source of solution for cleaning or sanitizing the taps and the connecting conduits is provided. A pump is connected by an inflow hose to the solution source and is connected to an outflow hose which has an output end with a fitting adapted to be connected in fluid flow communication to one of the connecting conduits when it disconnected from its beverage dispensing tap. Thus the cleaning solution can be circulated from the source through the one tap to the manifold and outward through the connecting conduits to the other taps. The taps are cleaned individually by successively opening each tap to permit outflow of sanitizing solution, which is preferably recovered in the source container and thus recycled through the system.

Further objects and advantages of the invention will become apparent through the accompanying detailed description, claims and accompanying drawings.

DETAILED DESCRIPTION OF PREFERRED EMBODIMENT

Figure 1:
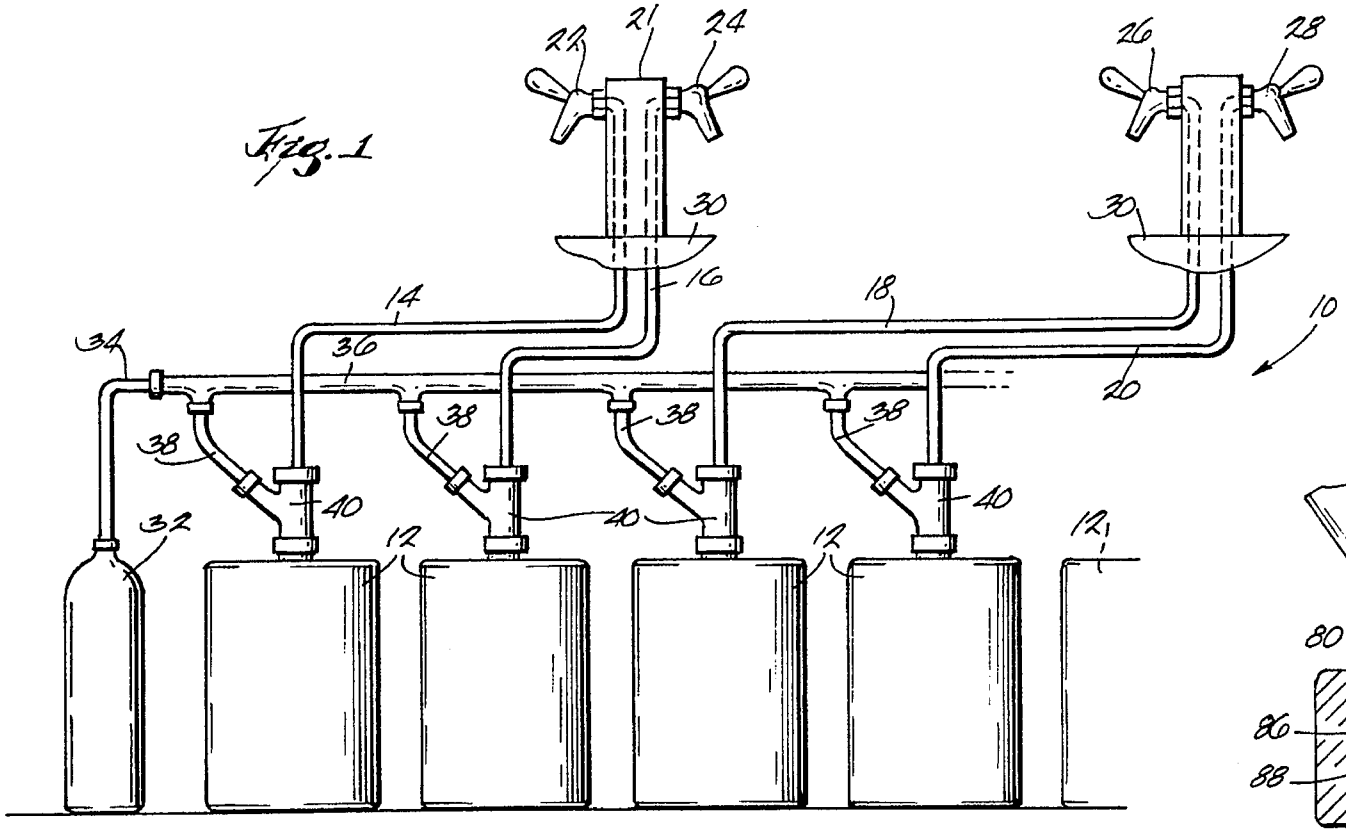
FIG. 1 is a side elevational view showing a beer dispensing tap system which can be cleaned in accordance with the invention.

Referring more specifically to the drawings there is seen a typical draft beer dispensing system 10. As shown, a number of kegs of beer 12 are coupled by hoses 14, 16, 18 and 20 to a series of taps 22, 24, 26 and 28, respectively. The taps are illustrated as being located above a bar surface 30. Typically kegs 12 are located in a refrigerated enclosure which may be, for example, a refrigerated cabinet under the bar or alternatively, for example, a walk-in cooler in the basement of the premises. In order to propel beer out of kegs 12 a pressurized source of gas 32, generally carbon dioxide, is provided. Pressurized gas source 32 is connected by tubing 34 to a manifold 36 which in turn is connected to further tubing 38 which leads to beer kegs 12 through a Y-shaped coupling 40 attached to each of the kegs. The Y-shaped couplings 40 also connect the beer kegs 12 to the series of hoses 14, 16, 18 and 20.

Figure 2:
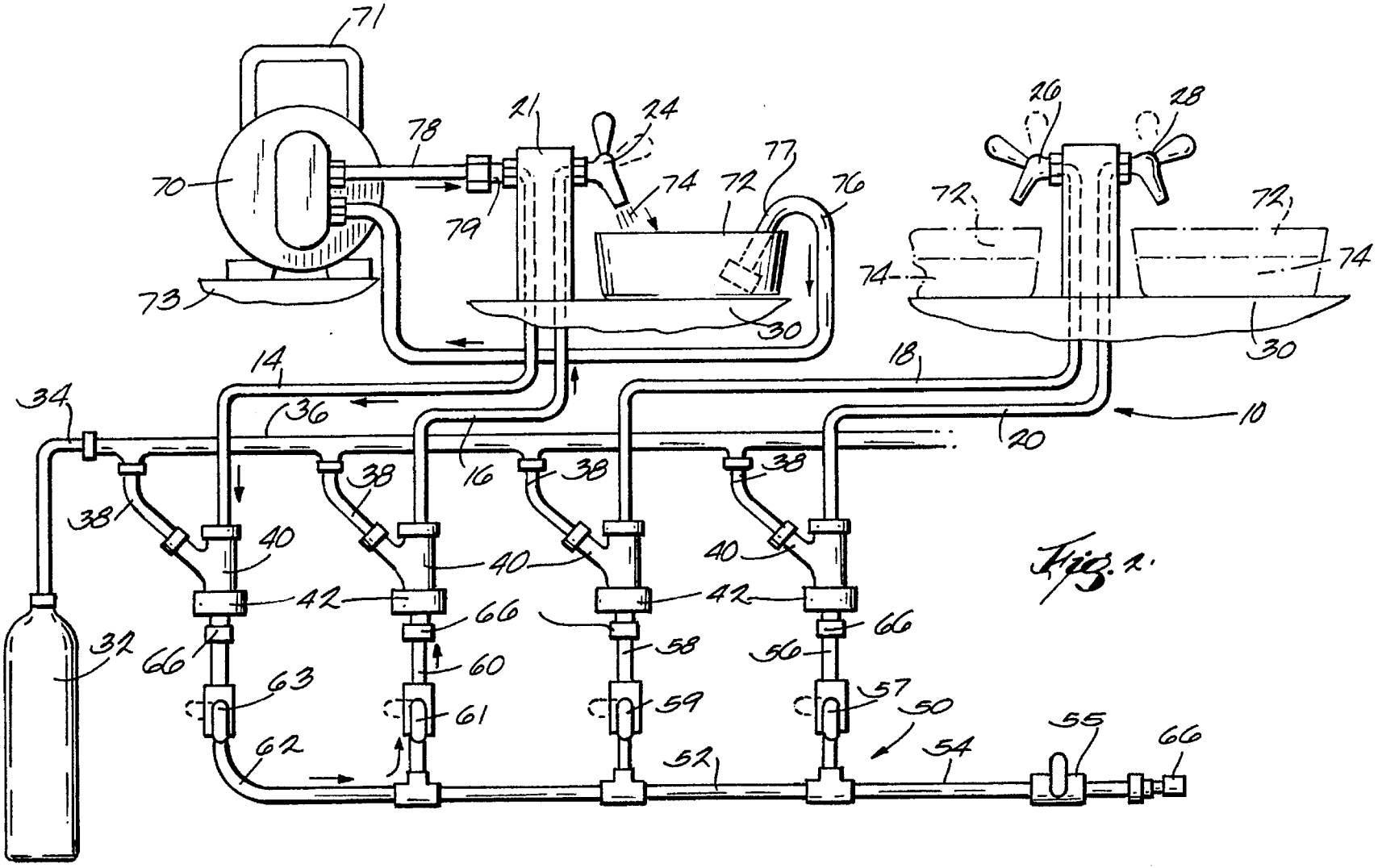
FIG. 2 is a side elevational view showing the device of this invention coupled to the beer dispensing equipment of FIG. 1; and, FIG. 3 is a cross sectional view showing a coupling and one way valve opening device in accordance with the invention.

Referring to FIG. 2, a sanitizing system of this invention is generally indicated by numeral 50. An important component of sanitizing system 50 is a manifold 52 which is connected to a series of 10 flexible hoses 54, 56, 58, 60 and 62. Each of these hoses is provided with a shut-off valve intermediate to its ends, 55, 57, 59, 61 and 63, respectively.

At the end of each of the hoses is a coupling device 66 which matches the fitting on the top of a keg 12 to which couplings 42 are attached. Thus one of the flexible hoses 54, 56, 58, 60 or 62 can be coupled to each of the Y-shaped fittings 40 after they have been removed from their respective kegs. Generally, the couplings 42 and 66 are of two different principal types dependent on the particular coupling employed by a specific brewery, as is well known in the industry. Thus it is desirable to include couplings 66 of each type anticipated to be encountered in the establishments in which the system is to be employed.

While manifold 52 is shown connected to five hoses for purposes of illustration, it will be understood that other numbers of hoses, for example, any number between two and 16 hoses can be provided in order to accommodate beverage serving establishments of varying sizes having varying numbers of beverage taps.

As further seen in FIG. 2 a pump 70 is provided which is adapted to be connected to a source 72 which may be an open topped container as seen within which a cleaning/sanitizing liquid 74 is contained, by means of a hose 76. The input of pump 70 is connected to hose 76. The output of pump 70 is connected by another hose 78 output pipe 78 is connected by means of appropriate coupling 79 to tap mount pedestal 21 from which, as seen in FIG. 2, tap 22 has been removed. Pump 70 is provided with a handle 71 so that it can be conveniently transported.

Figure 3:
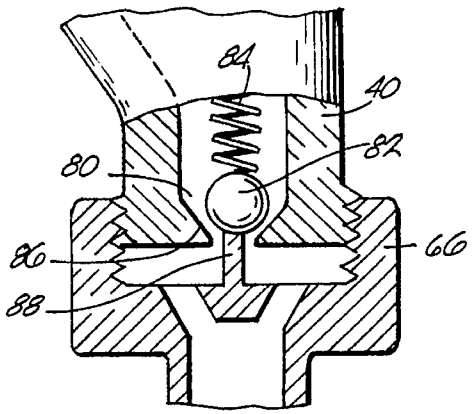

Referring to FIG. 3 there is seen a one way valve 80 of the type provided within each of the couplings 40. One way valve 80, as illustrated, consists of a ball valve 82 urged downwardly by a biasing spring 84 toward a restricted opening 86 in which thereby causes the valve 80 to be normally closed. To allow flow through fitting 40 each of the couplings 66 is provided with a projection 88 or similar means for opening valve 80 during the cleaning process.

Operation:

The operation of the cleaning system 50 will now be explained with further reference to the drawings. When cleaning of beverage dispensing system 10 is desired, the fittings 40 are disconnected from the tops of each of the kegs 12. The manifold 52 is then connected by means of couplings 66 to each of the fittings 40 which have been removed from the kegs 12. Any surplus hoses, for example, illustrated hose 54, can simply be maintained in an inactivated position by closure of its valve 55. Each of the other valves 57, 59, 61 and 63 are then opened to permit the flow therethrough of cleaning/sanitizing solution 74.

The solution 74 is provided or prepared by mixing of appropriate ingredients thereof and placement in a container 72 which forms the source of the cleaning/sanitizing solution 74. Pump 70 is placed on an appropriate supporting surface 73, for example, a bar top. One of the taps, for example tap 22, as illustrated, is removed from its mount 21. Hose 78 is then coupled to mount 21 by fitting 79. The hose 76 is placed so that its free end 77, which is preferably provided with a goose neck fitting, is placed in solution 74 within container 72. When pump 70 is activated a pressurized source of solution 74 is thus provided to the manifold 52 through hose 14 as illustrated by the fluid flow arrows in FIG. 2.

Each of the remaining taps 24, 26 and 28 can then successively be opened to allow the circulation through their connecting hoses back to container 72. It is possible to open two or more taps simultaneously provided they are in a location so that the flow of liquid 74 can be directed back into container 72. Thus the cleaning/sanitizing solution can be caused to flow for such a period of time as is desired through each of the taps 24, 26 and 28.

After each of the taps has been sanitized and/or cleaned container 72 can be emptied and filled with a rinsing liquid, usually water so that the cleaning solution 74 can be rinsed from the equipment. The rinsing process, then, involves the same steps as used in the cleaning/sanitizing process.

After sanitization in accordance with the foregoing procedure the pump 70 and manifold 52 can once again be disconnected from beverage dispensing system 10. Tap 22 can then be installed back on its mount 21. Each of the fittings 40 can then be connected to kegs 12. The system then is once again functional.

While preferred embodiments of the invention have been shown for purposes of illustration it will be understood that various modifications can be made by those skilled in the art. Thus reference should be made to the appended claims as indicating the true scope of the invention.

I claim:

1. A system for cleaning or sanitizing beverage dispensing equipment which includes a plurality of beverage sources each connected to a dispensing tap by means of a connecting conduit removably coupled to one of said sources and said tap comprising;

a manifold having a manifold body with a plurality of flexible hoses attached thereto, each of said hoses having a first end in fluid flow connection with said manifold body and a second end provided with a fitting adapted to be connected to one of said connecting conduits when disconnected from its beverage source, a source of solution for cleaning or sanitizing said taps and said connecting conduits, a pump connected by an inflow hose to said source of solution and connected to an outflow hose, said outflow hose having an output end with a fitting adapted to be connected in fluid flow communication to one of said connecting conduits when disconnected from one of said beverage dispensing taps, whereby said cleaning/sanitizing solution can be circulated from said source through said one tap to said manifold and outward through said connecting conduits to the others of said plurality of taps.

2. A system according to claim 1 wherein said second ends of said hoses are provided with means to open a one-way valve located in said conduits.

3. A system according to claim 1 wherein said manifold is formed of flexible hose material.

4. A system according to claim 3 wherein each of said flexible hoses attached to said manifold is provided with a valve whereby flow of liquids through each of said hoses can individually be controlled.

* * * * *